US005827085A

United States Patent [19]

Yodogawa

[11] Patent Number: 5,827,085

[45] Date of Patent: Oct. 27, 1998

[54] ELECTRICAL CONNECTOR AND METAL LATCH THEREOF

[75] Inventor: Akihiro Yodogawa, Fujisawa, Japan

[73] Assignee: Berg Techology, Inc., Reno, Nev.

[21] Appl. No.: 702,644

[22] PCT Filed: Mar. 22, 1995

[86] PCT No.: PCT/US95/03661

§ 371 Date: Sep. 6, 1996

§ 102(e) Date: Sep. 6, 1996

[87] PCT Pub. No.: WO95/26580

PCT Pub. Date: Oct. 5, 1995

[30] Foreign Application Priority Data

Mar. 25, 1994 [JP] Japan ..... 6-055762

[51] Int. Cl.[6] ..... H01R 13/62

[52] U.S. Cl. ..... 439/326; 439/570

[58] Field of Search ..... 439/326–329, 439/631–637, 59–62, 65

[56] References Cited

U.S. PATENT DOCUMENTS 5,169,333 12/1992 Yang Lee ..... 439/326

5,174,779 12/1992 Chung ..... 439/326

*Primary Examiner*—Hien Vu

*Attorney, Agent, or Firm*—Woodcock Washburn Kurtz Mackiewicz & Norris LLP

[57] ABSTRACT

The invention provides an electrical connector to which a metal latch can be easily attached. An attachment post (16*a*) mounted on an upper surface (18) of a housing (12) has a main wall (16*b*) and an outer side wall (30) opposed thereto. A front side wall (28), perpendicular to the main wall, is located at a front end of the main wall (16*b*). A central portion of the main wall (16*b*) has a rectangular engaging projection (40). A rear end of the main wall (16*b*) has a rear side wall (42) projecting outward to face the front side wall (28). A slot (46), having a rectangular cross section and defined by the main wall (16*b*), the outer side wall (30), the front side wall (28) and the rear side wall (42), is produced on the attachment post (16*a*). A base portion (62) of the metal latch (60), which is to be inserted in the slot (46), has forked portions (64) and (66) extending downward. The forked portions (64) and (66) are inserted into gaps (48) and (50) produced on both sides on an engaging projection (40) in the slot (46) and clamp the engaging projection (40), the result of which is that an end surface (90) of the base portion (62) of the latch (60) contacts an end (92) of the engaging projection (40).

15 Claims, 4 Drawing Sheets

ELECTRICAL CONNECTOR AND METAL LATCH THEREOF

FIELD OF THE INVENTION

The present invention relates generally to an electrical connector and a metal latch thereof, and more particularly to a connector for electrically connecting one circuit board with another and a metal latch used in the connector.

BACKGROUND OF THE INVENTION

Various electric connectors for connecting a main board with a sub-board, such as a single in-line memory module etc., are well known. For example, an electric connector disclosed in Japanese Utility Model Application "KOKAI" Publication No. 2-95183 (Japanese Utility Model Application No. 1-4128) comprises a resin housing to be attached to a main board, and a pair of metal latches for engaging with a sub-board.

An opening for receiving the sub-board is formed in an upper surface of the housing, and contact terminals for contacting the main and sub-boards with each other are arranged in the opening. Each of the metal latches is constituted by an engaging portion to be engaged with one of longitudinal ends of the housing, a spring portion projecting upward from the engaging portion, and a latch portion extending from she spring portion to be engaged with the sub-board. The engaging portion has a three-dimensional shape having three inner surfaces which contact the upper and both longitudinally side surfaces of the housing.

The metal latch is fixed to the housing by engaging the engaging portion with the housing, such that the engaging portion clamps the housing in a width direction of the housing. The sub-board is obliquely inserted into the opening, and then is rotated so as to be positioned between the pair of latches. During this step, the latches are pressed outward by side edges of the sub-board to be elastically bent in a direction in which the distance between the latches is increased. Then, when the sub-board reaches a predetermined position between the latches, the latches are elastically restored to an initial shape and clamp the sub-board. As a result, the sub-board is maintained in the predetermined position.

However, to attach the metal latch to the housing, it is necessary to press the three inner surfaces of the engaging portion of the metal latch against the upper and both side surfaces of the housing with strong force and this attachment requires force in three directions. For this reason, the process of attaching the metal latch to the housing is complicated and requires much time.

SUMMARY OF THE INVENTION

An object of the present invention is to provide an electric connector in which a metal latch can be easily attached to a housing. Another object of the present invention is to provide a metal latch which can be easily attached to a housing.

According to an aspect of the present invention, there is provided an electric connector for connecting a first circuit board to a second circuit board through a plurality of contact terminals. The electric connector comprises an integrally molded non-conductive housing and a pair of metal latches attached to the housing, each latch being formed of one piece of metal.

The housing includes an elongated opening being provided with the plurality of contact terminals and being adapted to receive the second circuit board, a restricting wall for restricting a rotation of the second circuit board when the second circuit board is inserted in the opening, and attachment posts respectively mounted at one and the other end portions of the opening.

Each attachment post is provided with a slot defined by four walls to have a rectangular cross section, and a main wall of the four walls, located nearer to the corresponding one end portion of the opening than the other three walls and opposed to the corresponding one end portion of the opening, has an engaging projection projecting in the slot with gaps being produced between the engaging projection and the two walls located on both sides of the main wall.

Each metal latch includes a fork portion shaped to be engaged with the engaging projection and the gaps located at both sides of the engaging projection in the slot of the housing, an arm portion extending from the fork portion along the main wall, a latch portion extending from the arm portion and shaped to engage with and hold the second circuit board in a predetermined position when the second circuit board is inserted in the opening of the housing, and a releasing portion, arranged near to the latch portion and selectively allowing disengagement of the second circuit board.

According to an embodiment of the present invention, the second circuit board has an engaging hole, and a rear wall of the housing has an engaging projection to be engaged with the engaging hole of the second circuit board.

According to another aspect of the present invention, there is provided a metal latch to be connected to attachment posts of an electric connector, the connector comprising an integrally molded non-conductive housing to be attached to a first circuit board. The housing includes an elongated opening being adapted to receive a second circuit board and being provided with a plurality of contact terminals for electrically connecting the first circuit board to the second circuit board, and a restricting wall for restricting a rotation of the second circuit board when the second circuit board is inserted in the opening. The attachment posts are respectively mounted at one and the other end portions of the opening, and each attachment post is provided with a slot defined by four walls to have a rectangular cross section. A main wall of the four walls, located nearer to the corresponding one end portion of the opening than the other three walls and opposed to the corresponding one end portion of the opening, has an engaging projection projecting in the slot with gaps being produced between the engaging projection and the two walls located on both sides of the main wall.

The metal latch comprises a fork portion shaped to be engaged with the engaging projection and the gaps located at both sides of the engaging projection in the slot of the housing, an arm portion extending from the fork portion along the main wall, a latch portion extending from the arm portion and shaped to engage with and hold the second circuit board in a predetermined position when the second circuit board is inserted in the opening of the housing, and a releasing portion arranged near to the latch portion and selectively allowing disengagement of the second circuit board.

According to an embodiment of the present invention, in the above described electric connector and the above described metal latch, the fork portion of the metal latch has a wedge-shaped portion which bites the engaging projection in the slot of the attachment post of the housing.

In addition, the arm portion of the metal latch has two bent portions opposed to the main wall of the attachment post of the housing, one bent portion, located nearer to the fork portion, is brought into contact with the wall of the four walls facing the main wall of the attachment post, thereby urging the metal latch so as to be fixed to the attachment post, and the other bent portion, located nearer to the latch portion, is brought into contact with the facing wall when the metal latch receives a load toward the facing wall, thereby preventing the metal latch from excessively deforming.

The metal latch may further comprise a soldering portion extended from the fork portion to be soldered to the first circuit board.

With the above arrangement, the fork portion of the metal latch is engaged with the engaging projection and the gaps in the slot of the housing, whereby the metal latch is attached to the housing.

DETAILED DESCRIPTION OF PREFERRED EMBODIMENTS

Figure 1:
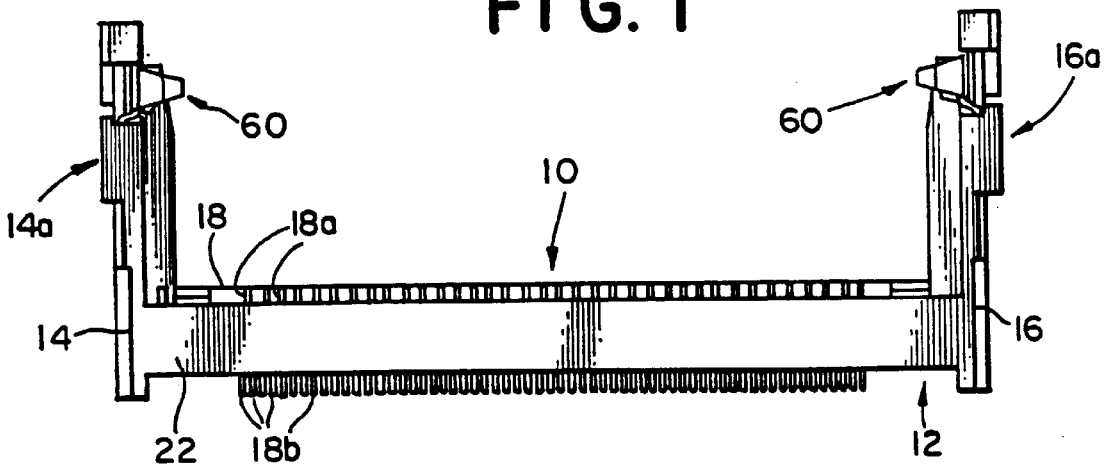
FIG. 1 is a front view of an electric connector according to an embodiment of the present invention.

In the drawings, the reference numerals refer to the connector and latch elements as follows: 10=electric connector, 12=non-conductive housing, 14*a*, 16*a*=attachment post, 16*b*=main wall, 18*a*=opening, 18*b*=contact terminal, 30=outer side wall (opposing wall), 40=engaging projection, 46=slot, 48=first gap, 50=second gap, 52=engaging projection, 54=restriction wall, 56=tab (soldering portion), 60=metal latch, 64, 66=straight beam (fork portion), 68=wedge-shaped projection (wedge-shaped portion), 70=arm portion, 76=first bent portion, 78=second bent portion, 80=latch portion, 82=releasing portion.

Figure 2:
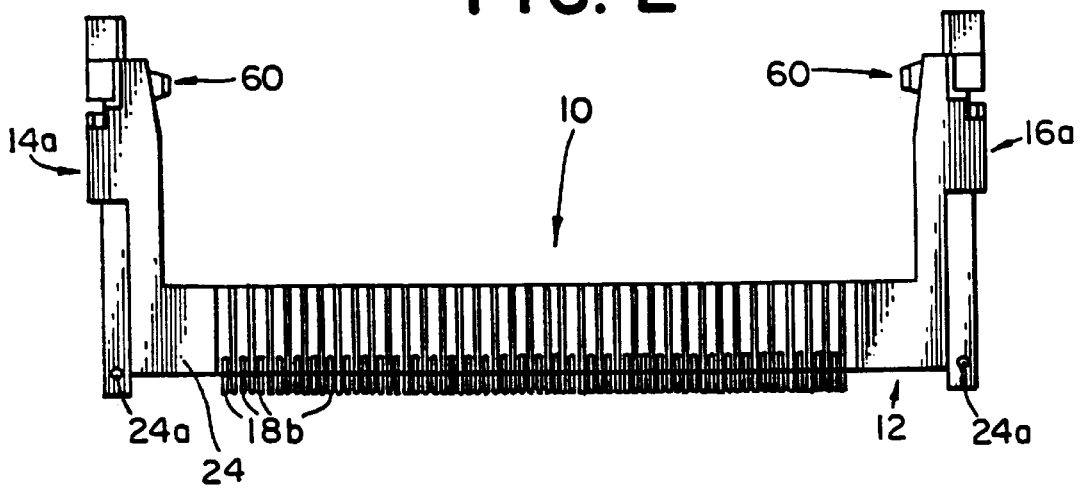
FIG. 2 is a rear view of the electric connector shown in FIG. 1.
Figure 3:
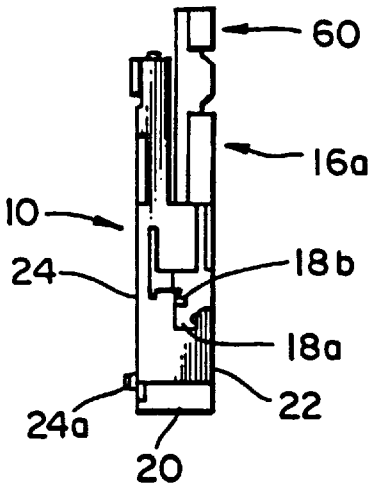
FIG. 3 is a side view of the electric connector shown in FIG. 1.
Figure 4:
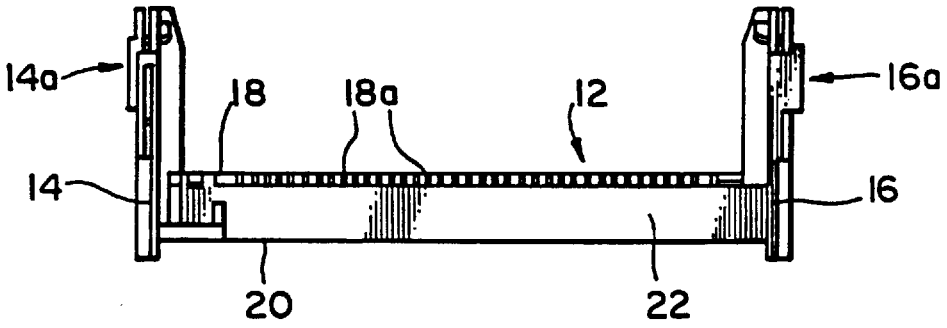
FIG. 4 is a front view of a housing of the electric connector shown in FIG. 1.
Figure 5:
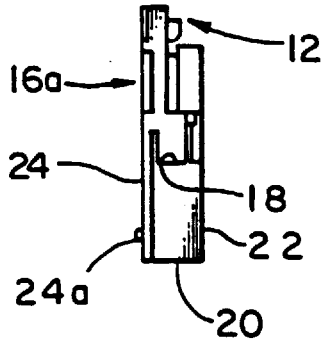
FIG. 5 is a side view of the housing shown in FIG. 4.

In FIGS. 1 to 3, an electric connector according to the present invention is designated by reference numeral 10. The electric connector 10 is an SIMM socket for connecting a single in-line memory module (SIMM) to a main circuit board. As shown in FIGS. 4 and 5, the SIMM socket 10 includes an integrally molded housing 12 having an elongated, substantially rectangular shape. The housing 12 is made of nonconductive material such as plastic. The housing 12 has longitudinal end portions 14 and 16 opposed to each other, upper and lower surfaces 18 and 20 opposed to each other, and front and rear walls 22 and 24 opposed to each other. Attachment posts 14*a* and 16*a* for attaching metal latches 60 to the housing 12 are mounted on the upper surface 18 in the end portions 14 and 16.

The rear wall 24 defines a region in which the electric connector is mounted on the main circuit board. The rear wall 24 has a pair of attachment legs 24*a* to be inserted into holes (not shown) formed in the main board. The upper surface 18 has an opening 18*a* extending between the longitudinal end portions 14 and 16. In this opening, a plurality of conductive contact terminals 18*b* are arranged in a direction in which the opening extends. The contact terminals 18*b* are well known SIMM contact terminals, and descriptions of a shape and a connection system thereof are omitted from this specification.

Figure 6:
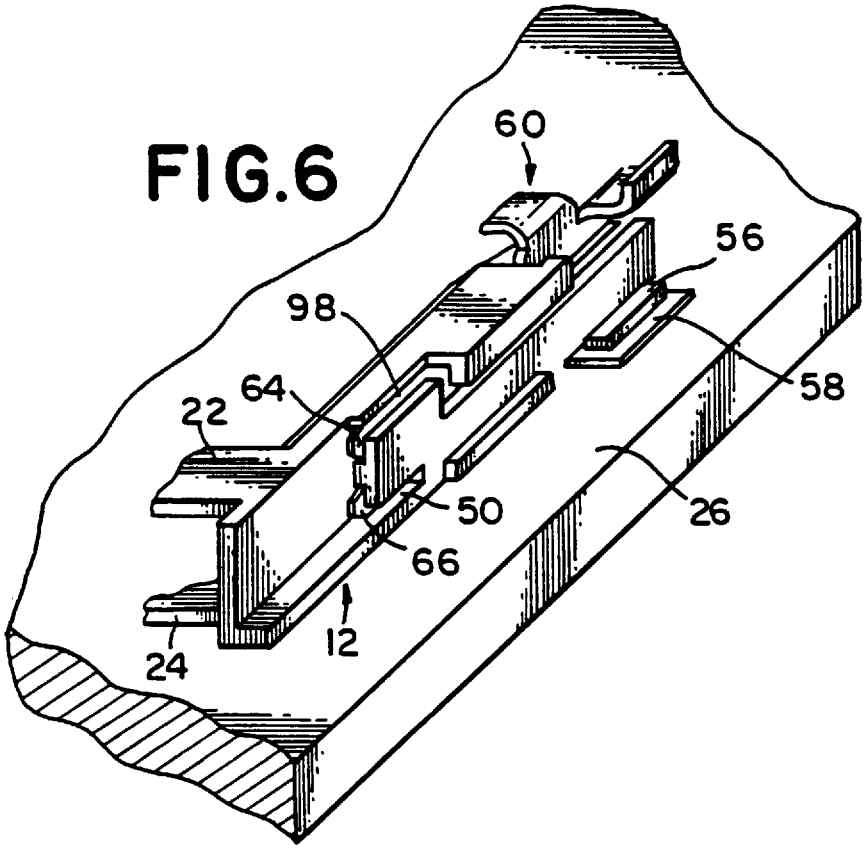
FIG. 6 is a perspective view of one end portion of the electric connector of the present invention in a state that the electric connector is attached to a main board.

FIG. 6 shows the attachment post 16*a* of the housing 12 and the metal latch 60 of the connector 10 mounted on the main circuit board 26. Since the longitudinal end portions 14 and 16 of the electric connector are symmetrical with each other, only one end portion 16 is shown.

Figure 7A:
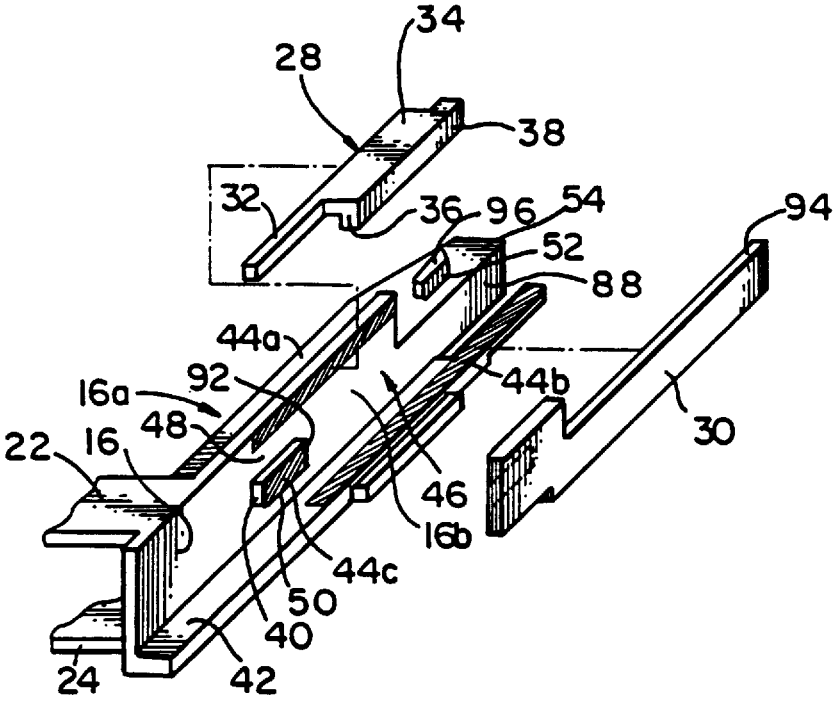
FIG. 7(A) is an exploded perspective view of an attachment post of the housing shown in FIG. 6.
Figure 7B:
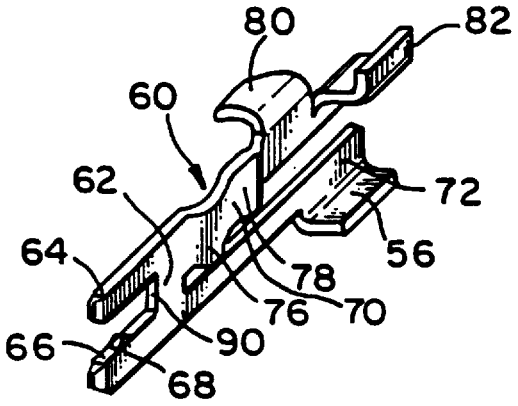
FIG. 7(B) is a perspective view of a metal latch shown in FIG. 6.

FIG. 7 (A) shows the attachment post 16*a* of the housing 12 shown in FIG. 6. Although, in FIG. 7 (A), a front side wall 28 and an outer side wall 30 are separated from the attachment post 16*a* in order to clarify the structure of the attachment post 16*a*, these are integrally formed at one time when the housing is integrally molded as described above.

As shown in FIG. 7 (A), the attachment post 16*a* has a main wall 16*b* extending upward from an end surface of the longitudinal end portion 16 of the housing 12. The front side wall 28, projecting perpendicular to the main wall, is located at a front end of the main wall 16*b*. The front side wall has a narrow portion 32 and a wide portion 34. An outer end of the wide portion 34 has a rib 36 projecting rearward. An upper end of the rib has a projection 38 which projects slightly above the wide portion 34.

A central portion of the main wall 16*b* has an engaging projection 40 having a substantially rectangular shape. At a rear end, the main wall 16*b* has a rear side wall 42 projecting outward to face the front side wall 28.

The front side wall 28 is integrated with the main wall 16*b* at a hatched portion 44*a*. The outer side wall 30 is integrated with the engaging projection 40 and the rear side wall 42 at hatched portions 44*c* and 44*b*, so as to face the main wall 16*b*.

A slot 46, having a rectangular cross section, is defined on the attachment post 16*a* by the main wall 16*b*, the outer side wall 30, the front side wall 28 and the rear side wall 42.

In the slot 46, a first gap 48 is produced between the narrow portion 32 of the front side wall 28 and the engaging projection 40. Similarly, a second gap 50 is produced between the engaging projection 40 and the rear side wall 42.

It is preferable that an engaging projection 52 for engaging with the SIMM board is positioned above the front side wall 28. The engaging projection 52 engages with an engaging hole (not shown) in the SIMM board. A flat restricting wall 54 located around the engaging projection 52 contacts a surface of an end portion of the SIMM board, thereby preventing the SIMM board from rotating rearward beyond the restriction wall 54.

FIG. 7 (B) shows only the metal latch 60 shown in FIG. 6. The metal latch 60 is integrally formed of one elastic metal plate by a press work. A fork portion, having two parallel straight beams 64 and 66 with a predetermined gap therebetween extends downward from a base portion 62 of the metal latch 60. It is preferable that one straight beam 66 have a wedge-shaped projection 68. Further, a flexibly deformable arm portion 70 and a fixing beam 72 extend upward from the base portion 62 in parallel to each other.

The arm portion 70 preferably has a rounded first bent portion 76 and a smaller rounded second bent portion 78. A hook-like latch portion 80 for engaging with the SIMM board extends inwardly from a front side edge of an extending end of the arm portion 70. The latch portion 80 is bent substantially 90° with respect to the arm portion 70 in order to engage with another surface of the end portion of the SIMM. A releasing portion 82 extends outward from the extending end of the latch portion 80. The releasing portion 82 is bent in a direction (the outside direction of the housing 10) opposite to that direction in which the latch portion 80 is bent, and a cross section of the releasing portion has an L-shape so that an operator can easily operate the releasing portion 82 by his or her finger. When the releasing portion 82 is depressed outward in the longitudinal direction of the housing 10 by the operator's finger, the latch portion 80 moves out from another surface of the one end portion of the SIMM board so that the board can be released from the latch portion.

An extending end of the fixing beam 72, located under the arm portion 70, extends substantially in parallel to the main wall 16*b* and forms a tab 56 to be soldered to a land 58 (FIG. 6) on a surface of the main circuit board 26.

A procedure for attaching the metal latch 60 shown in FIG. 7 (B) to the attachment post 16*a* shown in FIG. 7 (A) will now be described.

First, the metal latch 60 is inserted into the slot 46 from an upper or extending end 88 of the attachment post 16*a*, so that the straight beams 64 and 66 are directed downward. Then, the straight beams 64 and 66 are inserted into the gaps 48 and 50 produced on both sides of the engaging projection 40 in the slot 46, and clamp the engaging projection 40. Finally, a fork portion-side end 90 of the base portion 62 of the latch 60 contacts an end 92 of the engaging projection 40. Thus, the attachment of the latch to the housing 12 is completed.

The widths of the first and second gaps 48 and 50 on the attachment post 16*a* are substantially the same as or slightly greater than the widths of the corresponding straight beams 64 and 66. Hence, the wedge-shaped projection 68 of the straight beam 64 bites a material of the engaging projection 40, the result being that the latch 60 is fixed tightly to the attachment post 16*a*.

A positional relationship among the arm portion 70, the latch portion 80 and the release portion 82 of the metal latch 60 in a state that the metal latch 60 is attached to the housing 12 will now be described.

A top or outward end of the first bent portion 76 of the arm portion 70 is in contact with an inner side surface of the rib 36 of the wide portion 34. A rear side edge (cut line of the material) of the first and second bent portions 76 and 78 are located in front of a longer edge 94 of the stepped two front edges of the outer side wall 30, with a very small gap provided therebetween. A top or outward end of the second bent portion 78 is apart from the inner side surface of the rib 36 in a predetermined distance. The distance is great enough to displace the arm portion 70 outward and to cause the latch portion 80 to release the SIMM board. If the arm portion 70 is going to move outward beyond this distance, the top end of the second bent portion 78 is brought into contact with the inner side surface of the rib 36, i.e., the inner side surface of the projection 38, thereby preventing the arm portion 70 from excessively displacing.

The arm portion 70 is inclined inward across the first and second bent portions 76 and 78. Owing to the inclination, the latch portion 80 on the extending end of the arm portion 70 contacts and slightly presses a projecting end surface 96 of the engaging projection 52, the projecting end surface 96 being positioned more rearwardly than the front wall 22. Thus, the inclination of the arm portion 70 causes the arm portion 70 to produce a preload to the engaging projection 52. The rear side edge (cut line of the material) of the arm portion 70 is, of course, located above the restriction wall 54.

The metal latch 60 of this embodiment is designed so as to prevent the arm portion 70 and the latch portion 80 or the releasing portion 82 from excessively deforming, even when an undesirable load is applied to the latch portion 80 or the releasing portion 82 due to an erroneous operation of the operator.

When the latch portion 80 or the releasing portion 82 are drawn in a direction in which it is apart from the connector fixing surface of the circuit board 26, a front side edge (cut line of the material) of the arm portion 70 contacts a rear surface of the narrow portion 32, thereby preventing the latch portion and the releasing portion from excessively deforming. In contrast, when the latch portion 80 or the releasing portion 82 are pressed in a direction in which it is pressed against the connector fixing surface of the circuit board 26, the rear side edges (cut line of the material) of the first and second bent portions 76 and 78 contact the longer front edge 94 of the outer side wall 30, thereby preventing the arm portion 70 from excessively deforming.

As has been described above, according to the electric connector and the metal latch thereof of the present invention, since the metal latch can be attached to the housing simply by pressing the metal latch in one direction, an assembly of the electric connector is simplified. Further, since the portion of the metal latch, which is engaged with the housing, has a simple fork shape and has not a three-dimensional shape having three surfaces as in the conventional metal latch, the manufacturing cost is reduced.

We claim:

1. An electrical connector for connecting a first circuit board to a second circuit board through a plurality of contact terminals, comprising:

an integrally molded non-conductive housing, the housing including an elongated opening being provided with the plurality of contact terminals and being adapted to receive the second circuit board, a restricting wall for restricting a rotation of the second circuit board when the second circuit board is inserted in the opening, and attachment posts respectively mounted at one and the other end portions of the opening, each attachment post being provided with a slot defined by four walls to have a rectangular cross section, wherein a main wall of the four walls, located nearer to the corresponding one end portion of the opening than the other three walls and opposed to the corresponding one end portion of the opening, has an engaging projection projecting in the slot with gaps being produced between the engaging projection and two walls located on both sides of the main wall; and a pair of metal latches attached to the housing, each latch being formed of one piece of metal and including a substantially planar fork portion shaped to be secured in said slot and engaged with the engaging projection, an arm portion extending from the fork portion along the main wall, a latch portion extending from the arm portion and shaped to engage with and hold the second circuit board in a predetermined position when the second circuit board is inserted in the opening of the housing, and a releasing portion arranged near to the latch portion and selectively allowing disengagement of the second circuit board, wherein the fork portion of the metal latch has a wedge-shaped portion which bites the engaging projection in the slot of the attachment post of the housing.

2. An electrical connector according to claim 1, wherein the arm portion of the metal latch has two bent portions opposed to the main wall of the attachment post of the housing, one bent portion, located nearer to the fork portion, is brought into contact with the wall of the four walls facing the main wall of the attachment post, thereby urging the metal latch so as to be fixed to the attachment post, and the other bent portion, located nearer to the latch portion, is brought into contact with the facing wall when the metal latch receives a load toward the facing wall, thereby preventing the metal latch from excessively deforming.

3. An electrical connector according to claim 1, wherein the second circuit board has an engaging hole, and a rear wall of the housing has an engaging projection to be engaged with the engaging hole of the second circuit board.

4. An electrical connector for connecting a first circuit board to a second circuit board through a plurality of contact terminals, comprising:

an integrally molded non-conductive housing, the housing including an elongated opening being provided with the plurality of contact terminals and being adapted to receive the second circuit board, a restricting wall for restricting a rotation of the second circuit board when the second circuit board is inserted in the opening, and attachment posts respectively mounted at one and the other end portions of the opening, each attachment post being provided with a slot defined by four walls to have a rectangular cross section, wherein a main wall of the four walls, located nearer to the corresponding one end portion of the opening than the other three walls and opposed to the corresponding one end portion of the opening, has an engaging projection projecting in the slot with gaps being produced between the engaging projection and two walls located on both sides of the main wall; and a pair of metal latches attached to the housing, each latch being formed of one piece of metal and including a fork portion shaped to be engaged with the engaging projection and the gaps located at both sides of the engaging projection in the slot of the housing, an arm portion extending from the fork portion along the main wall, a latch portion extending from the arm portion and shaped to engage with and hold the second circuit board in a predetermined position when the second circuit board is inserted in the opening of the housing, and a releasing portion arranged near to the latch portion and selectively allowing disengagement of the second circuit board, wherein the fork portion of the metal latch has a wedge-shaped portion which bites the engaging projection in the slot of the attachment post of the housing;

wherein the metal latch further includes a fixing beam extended from said fork portion and a soldering portion extended from the fixing beam to be soldered to the first circuit board.

5. An electrical connector according to claim 4, wherein the fork portion of the metal latch has a wedge-shaped portion which bites the engaging projection in the slot of the attachment post of the housing; wherein the arm portion of the metal latch has two bent portions opposed to the main wall of the attachment post of the housing, one bent portion, located nearer to the fork portion, is brought into contact with the wall of the four walls facing the main wall of the attachment post, thereby urging the metal latch so as to be fixed to the attachment post, and the other bent portion, located nearer to the latch portion, is brought into contact with the facing wall when the metal latch receives a load toward the facing wall, thereby preventing the metal latch from excessively deforming; and wherein the second circuit board has an engaging hole, and a rear wall of the housing has an engaging projection to be engaged with the engaging hole of the second circuit board.

6. A metal latch to be connected to each of attachment posts of an electrical connector, the connector comprising an integrally molded non-conductive housing to be attached to a first circuit board, the housing including an elongated opening being adapted to receive a second circuit board and being provided with a plurality of contact terminals for electrically connecting the first circuit board to the second circuit board, and a restricting wall for restricting a rotation of the second circuit board when the second circuit board is inserted in the opening, the attachment posts being respectively mounted at one and the other end portions of the opening, and each attachment post being provided with a slot defined by four walls to have a rectangular cross section, wherein a main wall of the four walls, located nearer to the corresponding one end portion of the opening than the other three walls and opposed to the corresponding one end portion of the opening, has an engaging projection projecting in the slot with gaps being produced between the engaging projection and two walls located on both sides of the main wall, the metal latch comprising:

a substantially U-shaped planar fork portion shaped to be engaged with the engaging projection and located at both sides of the engaging projection in the slot of the housing;

an arm portion extending from the fork portion along the main wall;

a latch portion extending from the arm portion and shaped to engage with and hold the second circuit board in a predetermined position when the second circuit board is inserted in the opening of the housing; and a releasing portion arranged near to the latch portion and selectively allowing disengagement of the second circuit board;

wherein the fork portion of the metal latch has a wedge-shaped portion which bites the engaging projection in the slot of the attachment post of the housing.

7. A metal latch according to claim 6, wherein the arm portion of the metal latch has two bent portions opposed to the main wall of the attachment post of the housing, one bent portion, located nearer to the fork portion, is brought into contact with the wall of the four walls facing the main wall of the attachment post, thereby urging the metal latch so as to be fixed to the attachment post, and the other bent portion, located nearer to the latch portion, is brought into contact with the facing wall when the metal latch receives a load toward the facing wall, thereby preventing the metal latch from excessively deforming.

8. A metal latch to be connected to each of attachment posts of an electrical connector, the connector comprising an integrally molded non-conductive housing to be attached to a first circuit board, the housing including an elongated opening being adapted to receive a second circuit board and being provided with a plurality of contact terminals for electrically connecting the first circuit board to the second circuit board, and a restricting wall for restricting a rotation of the second circuit board when the second circuit board is inserted in the opening, the attachment posts being respectively mounted at one and the other end portions of the opening, and each attachment post being provided with a slot defined by four walls to have a rectangular cross section, wherein a main wall of the four walls, located nearer to the corresponding one end portion of the opening than the other three walls and opposed to the corresponding one end portion of the opening, has an engaging projection projecting in the slot with gaps being produced between the engaging projection and two walls located on both sides of the main wall, the metal latch comprising:

a fork portion shaped to be engaged with the engaging projection and the gaps located at both sides of the engaging projection in the slot of the housing;

an arm portion extending from the fork portion along the main wall;

a latch portion extending from the arm portion and shaped to engage with and hold the second circuit board in a predetermined position when the second circuit board is inserted in the opening of the housing; and a releasing portion arranged near to the latch portion and selectively allowing disengagement of the second circuit board; and further comprising a soldering portion extended from the fork portion to be soldered to the first circuit board.

9. A metal latch according to claim 8, wherein the fork portion of the metal latch has a wedge-shaped portion which bites the engaging projection in the slot of the attachment post of the housing; and wherein the arm portion of the metal latch has two bent portions opposed to the main wall of the attachment post of the housing, one bent portion, located nearer to the fork portion, is brought into contact with the wall of the four walls facing the main wall of the attachment post, thereby urging the metal latch so as to be fixed to the attachment post, and the other bent portion, located nearer to the latch portion, is brought into contact with the facing wall when the metal latch receives a load toward the facing wall, thereby preventing the metal latch from excessively deforming.

10. An electrical connector for connecting a first circuit board to a second circuit board, comprising:

a housing including an elongated opening adapted to receive the second circuit board, and at least one attachment post mounted at one end portion of the opening, said attachment post being provided with a slot defined by four walls, wherein a main wall has an engaging projection projecting into the slot; and a metal latch attachable to the housing, said latch being formed of one piece of metal and including a substantially planar U-shaped fork portion shaped to be engaged with the engaging projection in the slot of the housing, an arm portion extending from the fork portion along the main wall, a latch portion extending from the arm portion and shaped to engage with and hold the second circuit board in a predetermined position when the second circuit board is inserted in the opening of the housing, and a releasing portion allowing disengagement of the second circuit board;

wherein the fork portion of the metal latch has a wedge-shaped portion which bites the engaging projection in the slot of the attachment post of the housing.

11. An electrical connector according to claim 10, wherein the arm portion of the metal latch has two bent portions opposed to the main wall of the attachment post, one bent portion, located nearer to the fork portion, is brought into contact with a wall facing the main wall of the attachment post, thereby urging the metal latch so as to be fixed to the attachment post, and the other bent portion, located nearer to the latch portion, is brought into contact with the facing wall when the metal latch receives a load toward the facing wall, thereby preventing the metal latch from excessively deforming.

12. An electrical connector according to claim 10, wherein the second circuit board has an engaging hole, and a rear wall of the housing has an engaging projection to be engaged with the engaging hole of the second circuit board.

13. An electrical connector according to claim 10 further comprising a soldering portion extended from the fork portion of the latch to be soldered to the first circuit board.

14. An electrical connector for connecting a first circuit board to a second circuit board, comprising:

a housing including an elongated opening adapted to receive the second circuit board, and at least one attachment post mounted at one end portion of the opening, said attachment post being provided with a slot defined by four walls, wherein a main wall has an engaging projection projecting into the slot; and a metal latch attachable to the housing, said latch being formed of one piece of metal and including a fork portion shaped to be engaged with the engaging projection in the slot of the housing, an arm portion extending from the fork portion along the main wall, a latch portion extending from the arm portion and shaped to engage with and hold the second circuit board in a predetermined position when the second circuit board is inserted in the opening of the housing, and a releasing portion allowing disengagement of the second circuit board;

wherein the metal latch further includes a soldering portion extended from the fork portion to be soldered to the first circuit board.

15. An electrical connector according to claim 14, wherein the fork portion of the metal latch has a wedge-shaped portion which bites the engaging projection in the slot of the attachment post of the housing; wherein the arm portion of the metal latch has two bent portions opposed to the main wall of the attachment post of the housing, one bent portion, located nearer to the fork portion, is brought into contact with the wall of the four walls facing the main wall of the attachment post, thereby urging the metal latch so as to be fixed to the attachment post, and the other bent portion, located nearer to the latch portion, is brought into contact with the facing wall when the metal latch receives a load toward the facing wall, thereby preventing the metal latch from excessively deforming; and wherein the second circuit board has an engaging hole, and a rear wall of the housing has an engaging projection to be engaged with the engaging hole of the second circuit board.

* * * * *